US006091235A

United States Patent [19]

O'Neill

[11] Patent Number: 6,091,235

[45] Date of Patent: *Jul. 18, 2000

[54] POWER-ON CIRCUIT FOR LOW DROPOUT DUAL SUPPLY VOLTAGE REGULATOR

[75] Inventor: Dennis P. O'Neill, San Carlos, Calif.

[73] Assignee: Linear Technology Corporation, Milpitas, Calif.

[ * ] Notice: This patent is subject to a terminal disclaimer.

[21] Appl. No.: 09/078,945

[22] Filed: May 14, 1998

Related U.S. Application Data

[63] Continuation of application No. 08/908,293, Aug. 7, 1997, Pat. No. 5,781,002, which is a continuation of application No. 08/604,749, Feb. 23, 1996, abandoned.

[51] Int. Cl.[7] ..... G05F 5/00

[52] U.S. Cl. ..... 323/299; 232/284; 232/314

[58] Field of Search ..... 323/284, 289, 323/299, 311–317

[56] References Cited

U.S. PATENT DOCUMENTS

| | | | |
|---|---|---|---|
| 3,754,182 | 8/1973 | Morris et al. | 323/299 |
| 4,709,320 | 11/1987 | Konopka | 323/299 X |
| 4,755,741 | 7/1988 | Nelson | 323/289 |
| 4,792,747 | 12/1988 | Schroeder | 323/303 |
| 5,280,233 | 1/1994 | Poletto et al. | 323/269 |
| 5,410,241 | 4/1995 | Cecil | 323/315 |

OTHER PUBLICATIONS

"Initial Release: LT1580/LT1580–2.5: 7A, Very Low Dropout Regulator," Linear Technology, Inc., Milpitas, California, pp. 1–4, Jun. 1995.

*Primary Examiner*—Jessica Han
*Attorney, Agent, or Firm*—Fish & Neave; Robert W. Morris; Garry J. Tuma

[57] ABSTRACT

Efficient very low dropout (i.e., approximately equal to about $V_{CESAT}$ of the output transistor) dual supply voltage regulator circuits and methods are provided. The voltage regulators are capable of providing very low dropout irrespective of supply sequencing. Traditional supply sequencing problems are overcome by including an power-on circuit that monitors the output power supply during power-on. The power-on circuit is also coupled to any location in the regulator circuit where the drive current can be inhibited whenever the output power monitor senses that the output power supply is not fully operational. The power-on circuit operates to prevent drive current from being supplied to the output transistor unless output power is available so that the substrate of the regulator is not permitted to become forward biased (and thus prevents the establishment of an undesired latch condition).

31 Claims, 7 Drawing Sheets

POWER-ON CIRCUIT FOR LOW DROPOUT DUAL SUPPLY VOLTAGE REGULATOR

CROSS REFERENCE TO RELATED APPLICATION

This is a continuation of commonly assigned U.S. patent application Ser. No. 08/908,293, filed Aug. 7, 1997, now U.S. Pat. No. 5,781,002, which is a continuation of U.S. application Ser. No. 08/604,749, filed Feb. 23, 1996, now abandoned.

BACKGROUND OF THE INVENTION

This invention relates to voltage regulator circuits. More particularly, this invention relates to voltage regulator circuits for dual supply regulators in which one supply provides output current to the load and the other supply provides control power.

Voltage regulator circuits require a minimum voltage differential between the input supply voltage and the regulated output voltage in order to function properly. This voltage differential is known as the dropout voltage of the regulator. For a given supply voltage, the dropout voltage of the regulator limits the maximum regulated voltage which can be supplied to the load. Conversely, for a given output voltage, the dropout voltage determines the minimum supply voltage required to maintain regulation.

One potential deficiency in known voltage regulators is the tendency for such regulators to consume a larger percentage of the supplied power as the output voltage decreases. For example, a voltage regulator providing a 10 volt output with a 1 volt dropout results in a ten percent power loss, while an output of 2 volts (i.e., an output voltage) with the same 1 volt dropout results in a fifty percent power loss. However, there have been increasing requirements for voltage regulators to operate at lower and lower voltages (e.g., the voltage at which microprocessors are powered has continued to fall from 5 volts to below 3 volts). As microprocessor voltages continue to fall, their clock speeds and supply currents are increasing. Thus, low dropouts are required to efficiently supply modern microprocessor regulated voltage inputs.

Another consideration in integrated circuit voltage regulators is the utilization of an NPN transistor as the output transistor to take advantage of the smaller die size (versus a PNP transistor). Those regulators that utilize NPN output transistors are limited to a minimum dropout voltage of about 1 volt (i.e, approximately equal to $V_{BE}$ of the NPN transistor+$V_{CESAT}$ of a PNP that drives the base of the NPN transistor). Further, in many integrated circuit voltage regulators where the substrate is connected to the output, the control circuitry operates using the same supply as that which supplies the output power. As such, the control circuitry operates based on the difference between the input and the output of the device (i.e., the input-to-output differential). Thus, the dropout voltage is limited by the minimum operating voltage of the control circuitry, which is typically designed to operate down to about a 1 volt input-to-output differential.

A voltage regulator having a low dropout voltage is therefore capable of providing a regulated output voltage at a lower supply voltage than can a voltage regulator having a higher dropout voltage. A low dropout voltage regulator can also operate with greater efficiency, since the input/output voltage differential of the regulator, when multiplied by the output current, equals the power dissipated by the regulator in transferring power to the load. For at least these reasons, a voltage regulator circuit having a low dropout voltage has many useful applications, and can improve the performance and reduce the cost of other circuits in which the regulator circuit is used.

One known way of achieving a low dropout voltage is to provide individual supplies for the control circuitry and for the output power (i.e., dual supply regulators). The implementation of dual supply regulators, however, presents its own set of problems. One of the most severe problems is that of sequencing the individual supplies during power-on. As the two supplies are independent, it is often difficult to control which supply turns on first, thus resulting in a potentially dangerous situation. For example, if the regulator circuits do not function in a controlled manner regardless of which supply turns on first, the regulator may power up in a non-regulating condition or the regulator may latch. In either condition, the results may be severe, potentially resulting in destructive damage to the load (which could be an expensive microprocessor) caused by an output that goes to an unregulated high. One known solution to the problems associated with supply sequencing is to require a large minimum load (i.e., a large enough load to sink all of the drive current so that the output does not go to an unregulated high). This solution, however, is often not acceptable because it significantly degrades efficiency at lighter loads.

In view of the foregoing, it would be desirable to provide circuits that efficiently achieve a very low dropout voltage of less than 1 volt.

It would further be desirable to provide dual supply regulator circuits that efficiently provide a very low dropout voltage irrespective of supply sequencing during power-on.

SUMMARY OF THE INVENTION

It is therefore an object of the present invention to provide novel circuits that efficiently achieve a very low dropout voltage of less than 1 volt.

It is a further object of the present invention to provide novel dual supply regulator circuits that efficiently provide a very low dropout voltage irrespective of supply sequencing during power-on.

In accordance with these and other objects of the invention, dual supply regulator circuits having very low dropout voltage that operate efficiently irrespective of power-on sequencing are provided. In particular, voltage regulator circuits are provided having individual supplies for control circuitry and output power that are controlled by power-on circuitry. The power-on circuitry prevents potentially unregulated drive current from being supplied to the output transistor until both supplies are providing power. Additionally, the power-on circuitry prevents the regulator from latching (i.e., locking in an unregulated high state) by insuring that the output signal never exceeds the power input signal. Latching conditions can be particularly destructive because the voltage regulator circuits often remain in the latched state even after the power supply for the output transistor comes up.

The dual supply voltage regulators of the present invention eliminate the traditional problems associated with supply sequencing by providing an additional transistor coupled to the collector of the output transistor. The additional transistor may be an NPN transistor or a PNP transistor, depending on the design requirements for individual applications. The additional transistor operates to prevent the supply of drive current to the output stage whenever the output power supply is low. The additional transistor also prevents reverse current from passing through the base-collector diode of the output transistor so that the substrate diode does not forward bias and thus, no latch can form.

BRIEF DESCRIPTION OF THE DRAWINGS

The above and other objects of the present invention will be apparent upon consideration of the following detailed description, taken in conjunction with the accompanying drawings, in which like reference characters refer to like parts throughout, and in which:

FIG. 5 is a schematic block diagram of an alternate embodiment of a very low dropout dual supply voltage regulator circuit constructed in accordance with the principles of the present invention in which a diode-connected PNP transistor is utilized during power-on;

FIG. 6 is a schematic block diagram of another alternate embodiment of a very low dropout dual supply voltage regulator circuit constructed in accordance with the principles of the present invention in which a diode-connected NPN transistor is utilized during power-on; and FIG. 7 is a schematic block diagram of another alternate embodiment of a very low dropout dual supply voltage regulator circuit constructed in accordance with the principles of the present invention in which a Schottky diode is utilized during power-on.

DETAILED DESCRIPTION OF THE INVENTION

Figure 1:
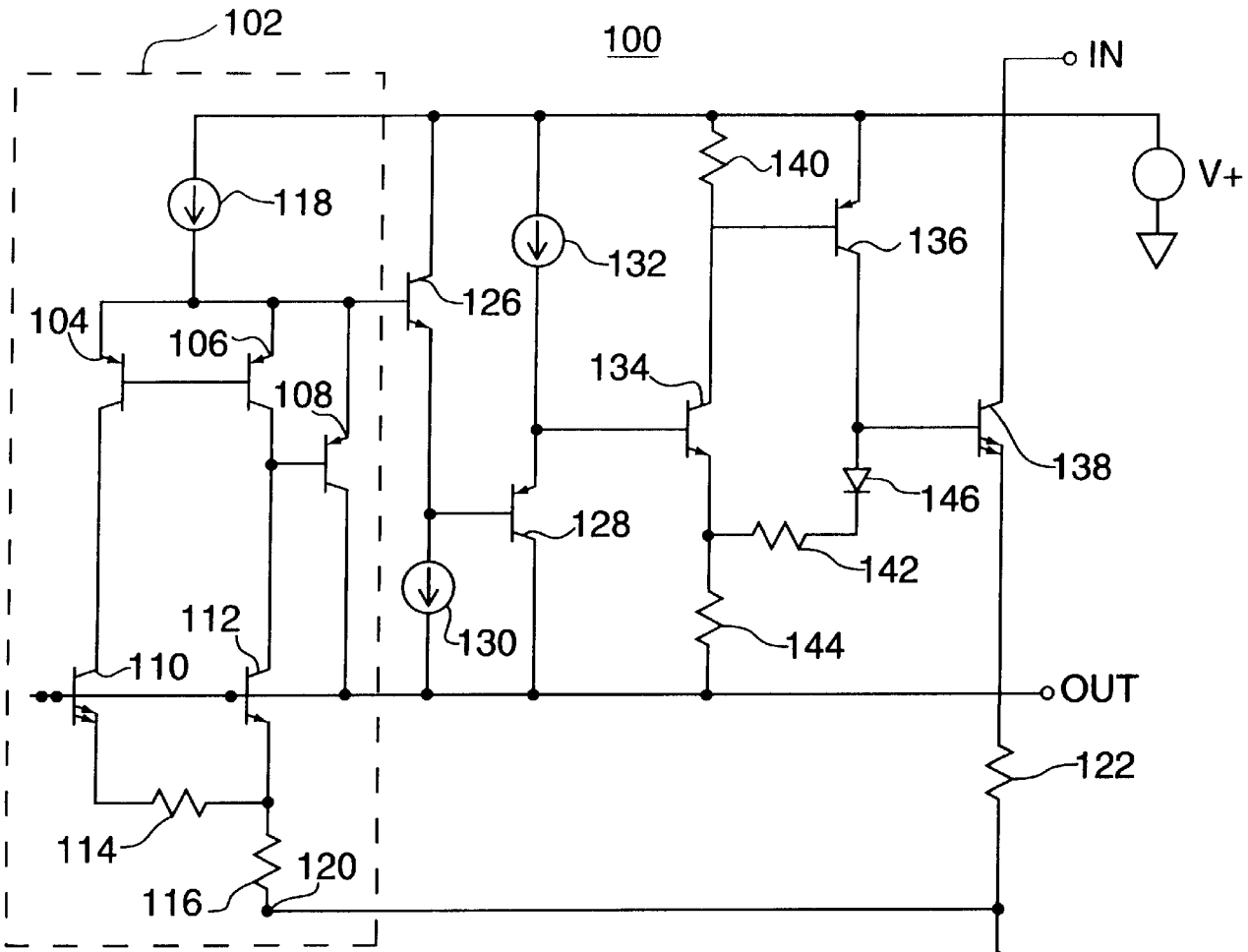
FIG. 1 PRIOR ART
FIG. 1 is a schematic block diagram of a known single supply voltage regulator circuit.

FIG. 1 is a simplified schematic diagram showing a known low dropout regulator 100 that is similar to the LT1083: 7.5A Low Dropout Positive Adjustable Regulator, available from Linear Technology Corporation, Milpitas, Calif. Regulator 100 includes a bandgap reference circuit 102 that is formed by PNP transistors 104, 106 and 108, NPN transistors 110 and 112, resistors 114 and 116, and current source 118 (that provides bias current to reference circuit 102). Reference circuit 102 servos the voltage between OUT and node 120 to 1.25 volts so that the current passing through resistor 122 is equal to 1.25/R122. Resistor 122 is chosen to have a value such that the current passing through resistor 122 is substantially larger than the current passing through transistors 110 and 112. As long as the value of resistor 122 is properly chosen, the output voltage of regulator 100 is equal to the ratio of resistor 124/resistor 122.

The signal is passed from reference circuit 102 to the output stage of regulator 100 by passing through level shifting transistors 126 and 128. Current source 130 provides bias current to NPN transistor 126, and current source 132 provides bias current to PNP transistor 128. The level shifted signal is supplied to the base of NPN transistor 134, which provides current gain from the reference stage to the output stage of regulator 100. The output stage of regulator 100 includes PNP transistor 136 and NPN transistor 138, which has its emitter coupled to OUT. Transistor 136, which provides the main base drive current for output transistor 138, is coupled to resistor 140 to provide pull-up for transistor 136 to turn transistor 136 off. Resistors 142 and 144, and diode 146 provide negative feedback for the output stage loop.

In regulator 100, both the control circuitry and the output circuitry are supplied through a common input node IN that is powered by a single voltage supply V+. Because both control power and output power must both pass through transistors 136 and 138, the minimum input/output voltage required to operate regulator 100 is set by $V_{BE}$ of transistor 138+$V_{CESAT}$ of transistor 136.

Figure 2:
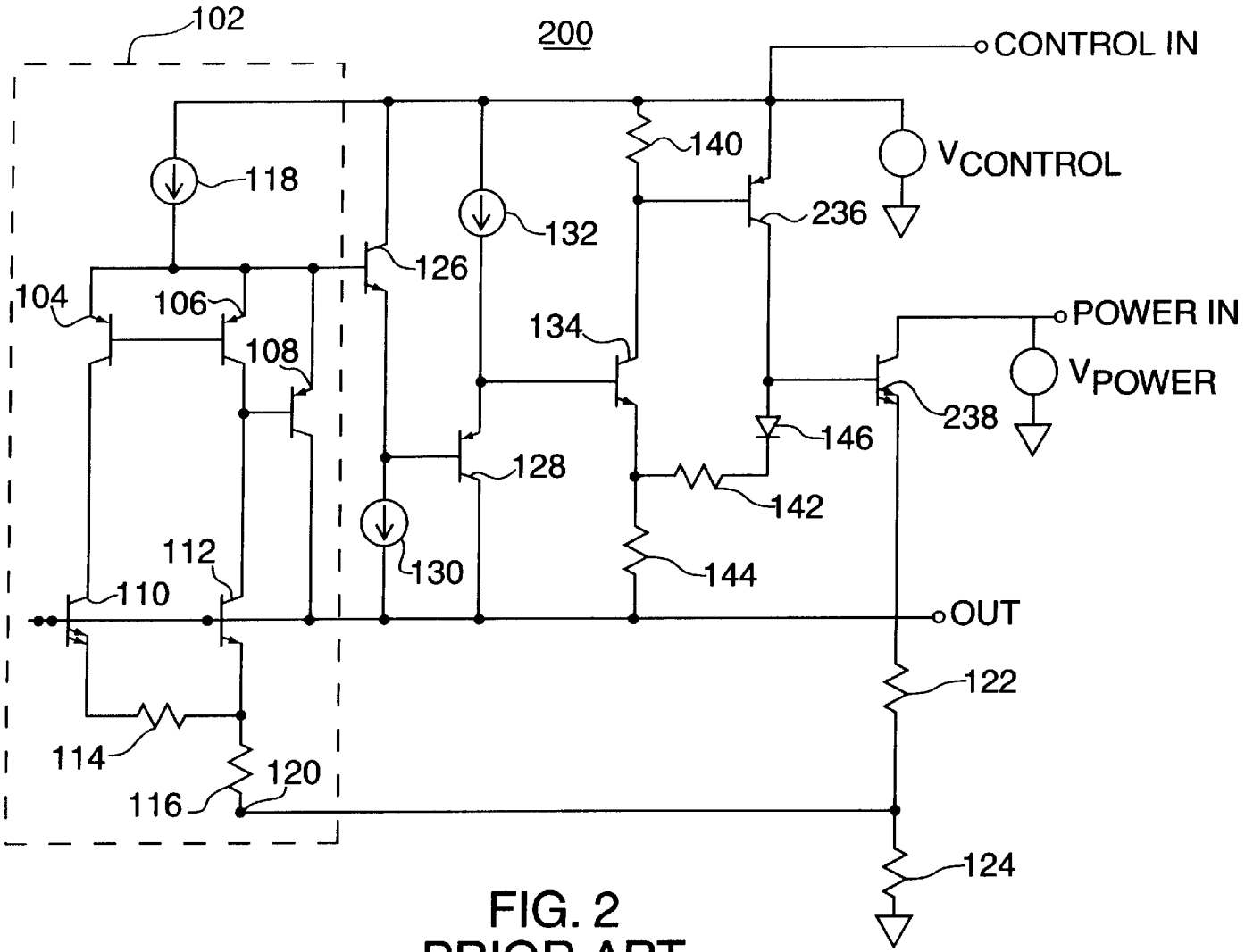
FIG. 2 PRIOR ART
FIG. 2 is a schematic block diagram of a known dual supply voltage regulator circuit.

FIG. 2 is a simplified schematic diagram showing a known low dropout regulator 200 that is similar to the LT-1580: 7A Very Low Dropout Regulator, available from Linear Technology Corporation, Milpitas, Calif. Regulator 200 is substantially similar to regulator 100 of FIG. 1, except that node IN and supply V+ are replaced by separate circuits for control and power (i.e., control power in regulator 200 is input through node CONTROL IN, which is supplied power from supply $V_{CONTROL}$, while output power is received through node POWER IN, which is supplied power from supply $V_{POWER}$). In all other respects, regulators 100 and 200 are substantially the same and therefore, for simplicity, like components are similarly numbered and are not discussed in detail for regulator 200.

Regulator 200 includes PNP transistor 236 and NPN output transistor 238 instead of transistors 136 and 138. The difference between regulators 100 and 200, which is a result of the splitting of input nodes and supplies between control power and output power, provides a dropout that is reduced from $V_{BE}$+$V_{CESAT}$ to $V_{CESAT}$. The dropout reduction is due to the fact that the emitter of transistor 236 is decoupled from the collector of transistor 238 so that output power travels from POWER IN through saturated transistor 238 to OUT. The configuration of regulator 200 operates with a drive current that is relatively small compared to the output current of transistor 238 (typically, on the order of one to three percent). The lower dropout enables regulator 200 to be used in many more applications because of the reduction in dropout (e.g., the lower dropout results in a lower minimum operating voltage).

Although regulator 200 provides a very low dropout, regulator 200 also suffers from supply sequencing problems. These problems are due to the fact that the two power supplies (i.e., $V_{CONTROL}$ and $V_{POWER}$) are independent and voltage regulator 200 cannot control the sequence at which the two supplies become fully operational. If $V_{CONTROL}$ becomes fully operational before $V_{POWER}$, problems are likely to result. The results may even be as severe as the complete destruction of the load circuitry if regulator 200 latches (i.e., locks into a state in which an unregulated high is output).

Figure 3:
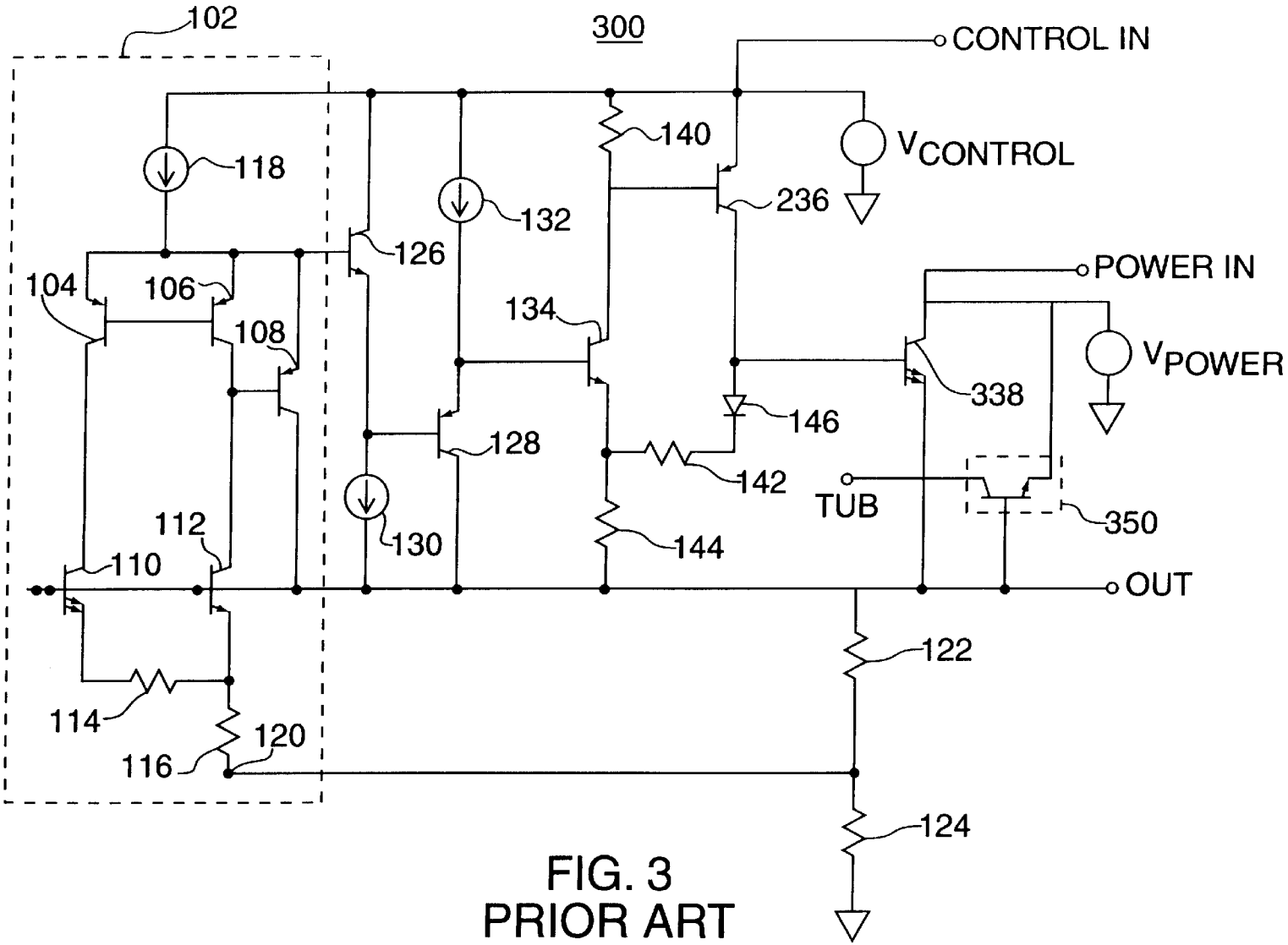
FIG. 3 PRIOR ART
FIG. 3 is a schematic block diagram of a known dual supply voltage regulator circuit that illustrates the problems of supply sequencing.

FIG. 3 is a schematic block diagram of a regulator 300 that illustrates the problems associated with supply sequencing. Regulator 300 is substantially similar to regulator 200, and as such, similarly numbered components are not discussed with respect to FIG. 3 (for a complete discussion of the components of FIG. 3, see the discussion of regulators 100 and 200 above). Regulator 300 includes transistor 338 (as a replacement for transistor 238 of FIG. 2) and substrate transistor 350, which is established when current is driven backwards through the base-collector diode of transistor 338, as is described more fully below.

The control circuitry for regulators 100, 200 and 300 are all connected between the input and output of the respective devices. In each case, the substrate of the device is connected to OUT. If $V_{CONTROL}$ is fully operational before $V_{POWER}$, then transistor 236 turns on causing a drive current to be input to the base of transistor 338. The input to transistor 338 (i.e., the collector of transistor 338), however, is still low while the impedance at OUT is high so that the drive current is driven through the base-collector diode of transistor 338 (instead of causing transistor 338 to conduct from the collector to the emitter, as in normal operations). This drive current causes regulator 300 to latch at light loads—a condition that may remain even after $V_{POWER}$ is fully operational—and the output goes to an unregulated high.

The latching occurs because the backwards driven current causes the substrate to be pulled up above the collector of transistor 338 (the collector of transistor 338 is held low by external supply $V_{POWER}$). As such, a transistor 350 is established whereby the collector of transistor 338 acts like an emitter, the substrate acts like a base, and the collector of transistor 350 may be any other tub in the substrate. (This discussion assumes that the standard junction isolated bipolar process is used in which the substrate is P-type and the tubs are N-type wells to isolate individual devices in the circuit. The substrate must be biased more negative than any of the tubs or the parasitic diodes from the substrate to the tubs can forward bias.) Once this occurs, the regulator is essentially uncontrollable.

As described briefly above, one solution is to require a large minimum load connected to OUT. Under such circumstances, the large minimum load forms a current path to sink enough of the drive current to prevent the latch from forming. This solution, however, is simply not acceptable to most users because of the wasted power that results. Namely, the large minimum load solution significantly degrades the operational efficiency of the regulator at light loads by requiring significantly more power even when the regulator is not being utilized.

Figure 4:
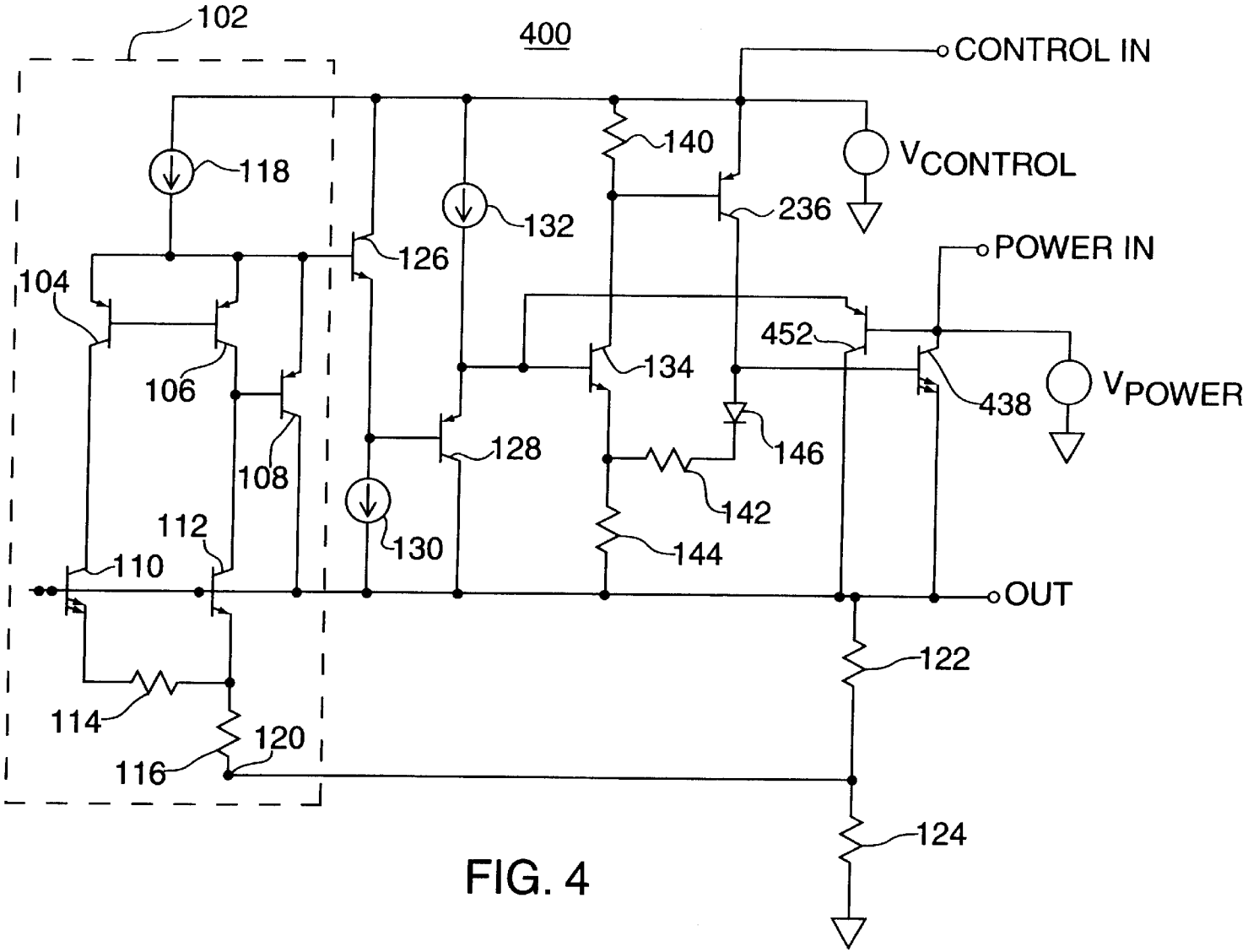
FIG. 4 is a schematic block diagram of a very low dropout dual supply voltage regulator circuit constructed in accordance with the principles of the present invention.

A more advantageous and practical solution is described with respect to FIG. 4 in which a regulator 400 provides very low dropout irrespective of supply sequencing in accordance with the principles of the present invention. As with FIGS. 2 and 3, regulator 400 includes many components that are substantially similar to those described above and, as such, are not described again here. The difference between regulator 400 and the previously described regulators is that output transistor 438 is coupled to PNP power-on transistor 452 to prevent regulator 400 from latching. Persons skilled in the art will appreciate that power-on transistor 452 may be either a lateral or vertical PNP transistor without departing from the spirit of the present invention.

Power-on transistor 452 has its base coupled to POWER IN and to the collector of output transistor 438. The emitter of transistor 452 is coupled to the base of gain transistor 134, while the collector of transistor 452 is coupled to OUT. Transistor 452 prevents regulator 400 from latching as follows. As long as $V_{POWER}$ is low, the base of transistor 452 is low which clamps the base of gain transistor 134 to one $V_{BE}$ above $V_{POWER}$. While gain transistor 134 is clamped, no drive current is supplied to transistor 236. Without drive current from transistor 236, there cannot be drive current passing through the base-collector of transistor 438 and no latch occurs (because the substrate does not forward bias). In this manner, power-on transistor 452 prevents OUT from being pulled above $V_{POWER}$ so that an unregulated high is not provided to OUT.

Figure 5:
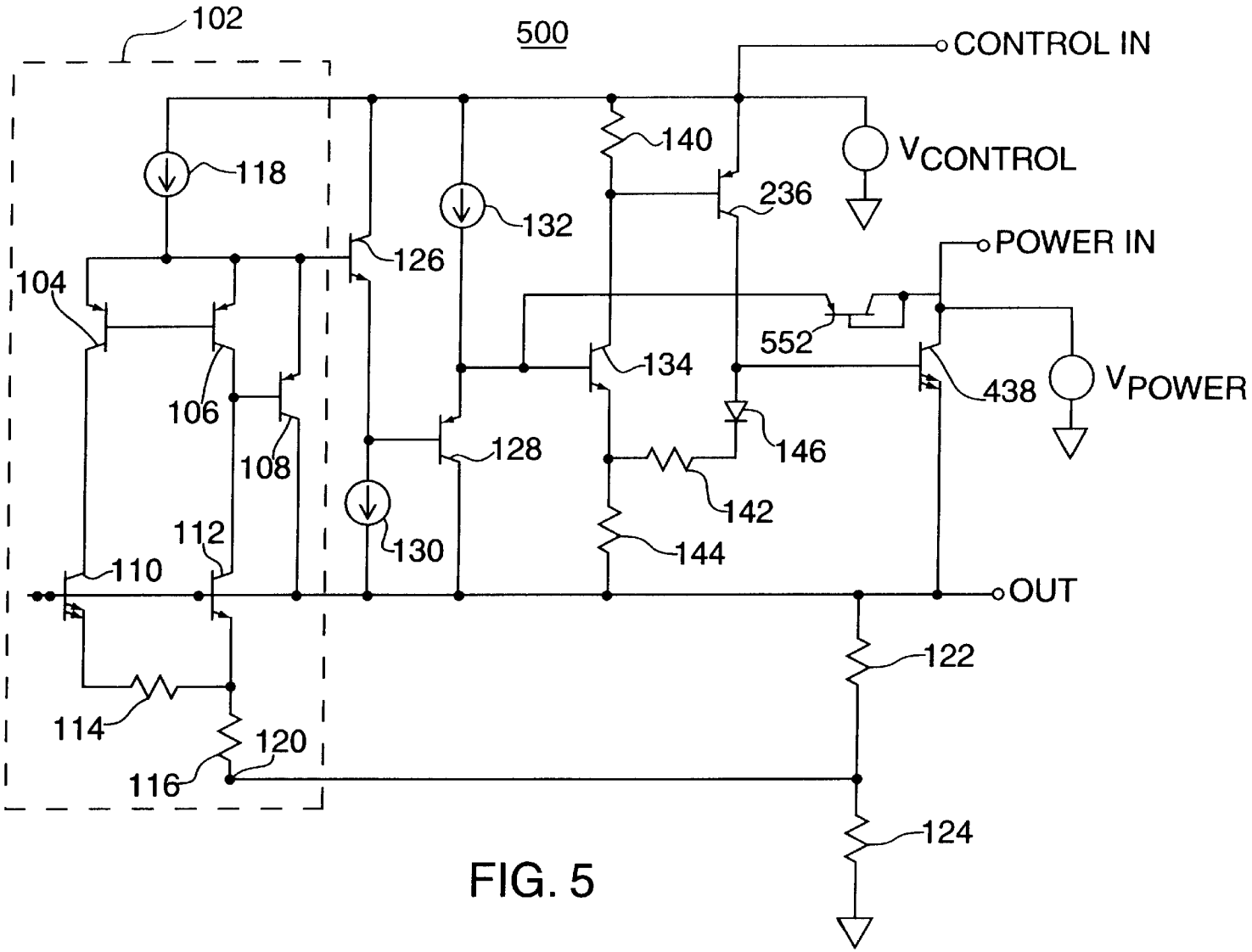
Figure 6:
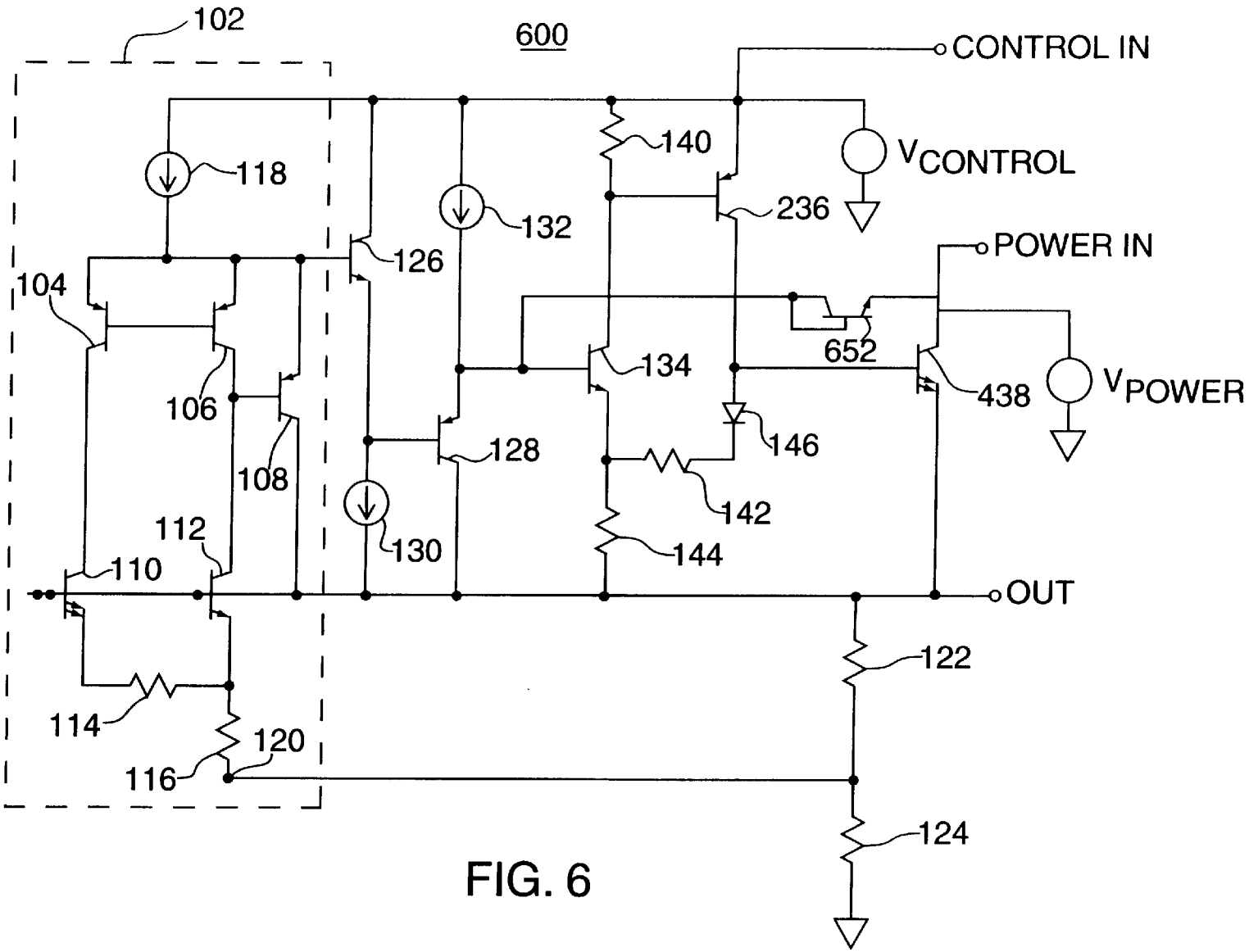

FIGS. 5 and 6 show two alternate embodiments of regulators in accordance with the principles of the present invention. In both FIGS. 5 and 6, the regulators shown and described are substantially similar to regulator 400 of FIG. 4. Therefore, and for the sake of simplicity, similar components are identically numbered and the descriptions above apply equally to FIGS. 5 and 6. The substantial difference between regulator 400 of FIG. 4 and regulator 500 of FIG. 5 is that power-on transistor 452 is replaced by diode-connected power-on PNP transistor 552. Power-on transistor 552 has an emitter coupled to the base of transistor 134, and a base and collector coupled to $V_{POWER}$. Power-on transistor 552 operates in basically the same manner as power-on transistor 452 described above.

Figure 7:
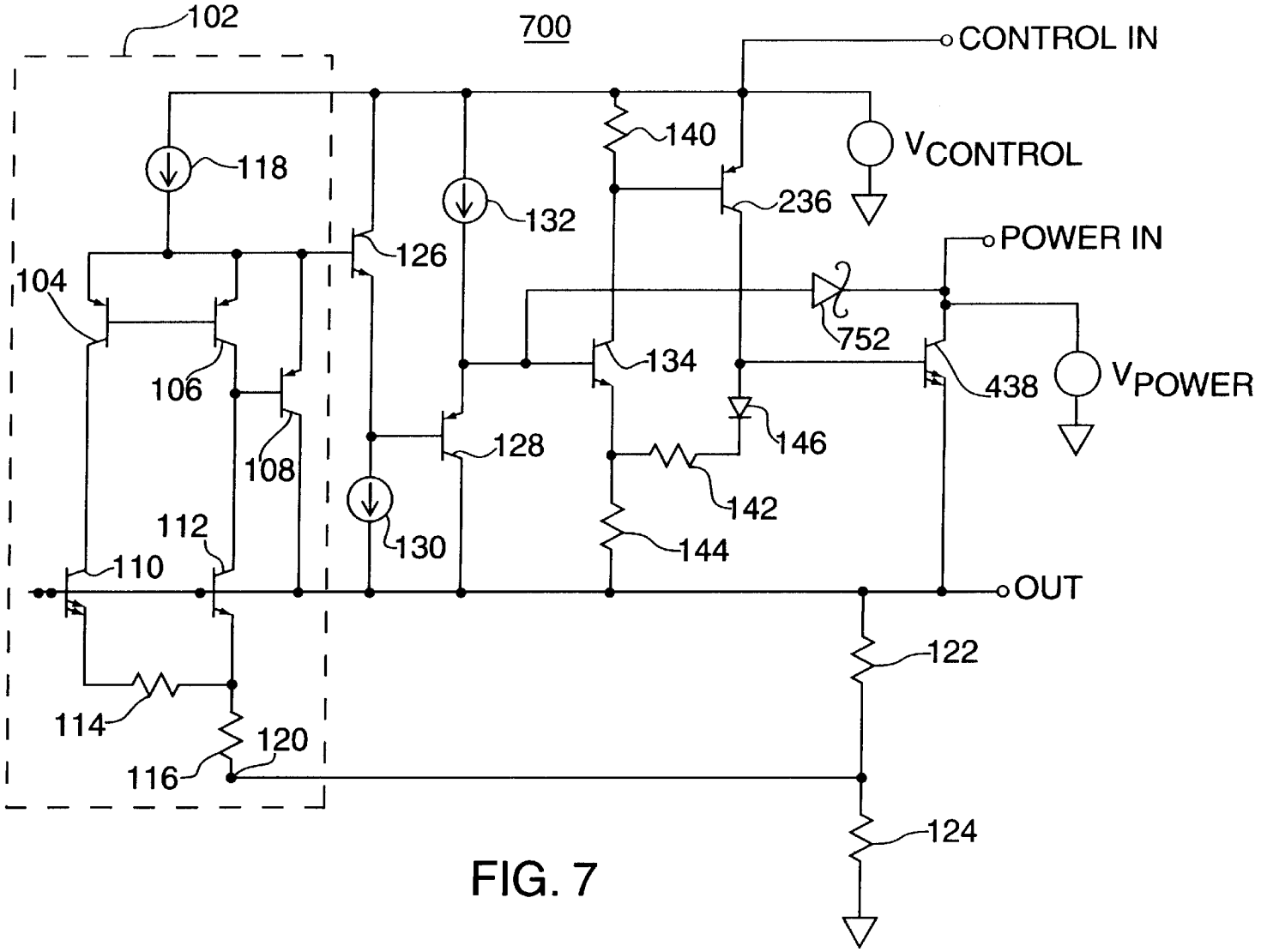

FIG. 6, on the other hand, shows power-on transistor 452 being replaced by diode-connected NPN power-on transistor 652. Power-on transistor 652 has an emitter coupled to $V_{POWER}$, and a base and collector coupled to the base of transistor 134. Power-on transistor 652 operates in basically the same manner as power-on transistors 452 and 552 described above. Persons skilled in the art will appreciate that the principles of the present invention may also be practiced by using a Schottky diode, as shown in FIG. 7, instead of either one of diode-connected transistors 552 and 662.

The very low dropout regulators of the present invention have been shown and described having an power-on transistor connected to the base of the gain transistor. Persons skilled in the art will appreciate that the principles of the present invention may be equally applied to regulators in which an power-on transistor is coupled to inhibit drive at various other points in the regulator circuit. There is only one location, however, where the power-on transistor may be coupled to accurately sense whether $V_{POWER}$ is fully operational, and that point is the junction where the collector of the output transistor is coupled to $V_{POWER}$.

Persons skilled in the art will thus appreciate that the present invention can be practiced by other than the described embodiments, which are presented for purposes of illustration and not of limitation, and thus the present invention is limited only by the claims which follow.

What is claimed is:

1. A very low dropout dual supply voltage regulator circuit comprising:

a control input node that receives control power;

a power input node that receives output power, said power input node being isolated from said control input node;

an output node;

a drive circuit that provides drive current in response to said control power, said drive circuit being coupled to said control node, said drive circuit comprising a driver transistor;

an output circuit coupled between said power input node and said output node, said output circuit comprising an output transistor coupled to said driver transistor; and a power-on circuit coupled to said power input node and to said drive circuit, said power-on circuit permitting said drive current to cause output voltage to rise as power input node voltage rises when said power input node is LOW while preventing said drive current from increasing without limitation when said power input node is LOW, said power-on circuit comprising at least one circuit device selected from the group consisting of a transistor and a diode, said circuit device having at least one P-type region and at least one N-type region, said N-type region being coupled to said power input node.

2. The very low dropout dual supply voltage regulator circuit of claim 1, wherein said circuit device comprises a PNP transistor having a base coupled to said power input node, a collector coupled to said output node, and an emitter coupled to said drive circuit.

3. The very low dropout dual supply voltage regulator circuit of claim 2, wherein said PNP transistor is a lateral PNP transistor.

4. The very low dropout dual supply voltage regulator circuit of claim 2, wherein said PNP transistor is a vertical PNP transistor.

5. The very low dropout dual supply voltage regulator circuit of claim 1, wherein said circuit device comprises a diode-connected PNP transistor having a base and collector coupled together and to said power input node.

6. The very low dropout dual supply voltage regulator circuit of claim 1, wherein said circuit device comprises a diode-connected NPN transistor having an emitter coupled to said power input node.

7. The very low dropout dual supply voltage regulator circuit of claim 1, wherein said circuit device comprises a Schottky diode having an anode coupled to said drive circuit and a cathode coupled to said power input node.

8. The very low dropout dual supply voltage regulator circuit of claim 1 further comprising a bandgap reference circuit coupled to said output node and to said drive circuit.

9. The very low dropout dual supply voltage regulator circuit of claim 8 further comprising a level shifting circuit coupled between said bandgap reference circuit and said drive circuit.

10. The very low dropout dual supply voltage regulator circuit of claim 9, wherein said power-on circuit is coupled to a node between said drive circuit and said level shifting circuit.

11. A very low dropout dual supply voltage regulator circuit comprising:

a control input node that receives control power;

a power input node that receives output power, said power input node being isolated from said control input node;

an output node;

an output transistor coupled to said output node and to said power input node;

a driver transistor coupled between said control input node and the base of said output transistor to provide drive current to said output transistor; and a power-on transistor coupled to said power input node and to said driver transistor that permits said drive current to cause output voltage to rise as power input node voltage rises when said power input node is LOW while preventing said output transistor from going into saturation when said power input node is LOW.

12. The very low dropout dual supply voltage regulator circuit of claim 11 further comprising a bandgap reference circuit coupled to said output node and to said driver transistor.

13. The very low dropout dual supply voltage regulator circuit of claim 12 further comprising a level shifting circuit coupled between said bandgap reference circuit and said driver transistor.

14. The very low dropout dual supply voltage regulator circuit of claim 13, wherein said power-on transistor is coupled between said level shifting circuit and said driver transistor.

15. The very low dropout dual supply voltage regulator circuit of claim 11, wherein said power-on transistor comprises a PNP transistor having a base coupled to said power input node, a collector coupled to said output node, and an emitter coupled to said driver transistor.

16. The very low dropout dual supply voltage regulator circuit of claim 15, wherein said PNP transistor is a lateral PNP transistor.

17. The very low dropout dual supply voltage regulator circuit of claim 15, wherein said PNP transistor is a vertical PNP transistor.

18. The very low dropout dual supply voltage regulator circuit of claim 11, wherein said power-on transistor comprises a diode-connected PNP transistor having a base and collector coupled together and to said power input node.

19. The very low dropout dual supply voltage regulator circuit of claim 11, wherein said power-on transistor comprises a diode-connected NPN transistor having an emitter coupled to said power input node.

20. The very low dropout dual supply voltage regulator circuit of claim 11, wherein said regulator circuit has a dropout voltage approximately equal to $V_{CESAT}$ of said output transistor.

21. The very low dropout dual supply voltage regulator circuit of claim 11, wherein drive current sufficient to cause latching is prevented from being drawn from the collector of said output transistor when said power input node is LOW.

22. A very low dropout dual supply voltage regulator circuit comprising:

a control input node that receives control power;

a power input node that receives output power, said power input node being isolated from said control input node;

an output node;

a drive circuit comprising a driver transistor that provides drive current in response to said control power, said drive circuit being coupled to said control node;

an output circuit coupled between said power input node and said output node, said output circuit comprising an output transistor coupled to said driver transistor; and a power-on circuit coupled to said power input node and to said drive circuit that permits said drive current to cause output voltage to rise as power input node voltage rises when said power input node is LOW while preventing said drive current from overdriving said output circuit when said power input node is LOW, said power-on circuit comprising at least one circuit device selected from the group consisting of a transistor and a diode, said circuit device having at least one P-type region and at least one N-type region, said N-type region being coupled to said power input node.

23. A very low dropout dual supply voltage regulator circuit comprising:

a control input node that receives control power;

a power input node that receives output power, said power input node being isolated from said control input node;

an output node;

means for providing power from said power input node to said output node;

means for driving a drive current into said means for providing power in response to said control power; and means for preventing said means for driving from increasing drive current without limitation when said means for preventing senses that said power input node is low.

24. The very low dropout dual supply voltage regulator circuit of claim 23, wherein said means for preventing is a PNP transistor having a base coupled to said power input node.

25. The very low dropout dual supply voltage regulator circuit of claim 24, wherein said PNP transistor is a diode-connected PNP transistor having a base and collector coupled together and to said power input node.

26. The very low dropout dual supply voltage regulator circuit of claim 23, wherein said means for preventing is a diode-connected NPN transistor having an emitter coupled to said power input node.

27. The very low dropout dual supply voltage regulator circuit of claim 23, wherein said means for preventing is a Schottky diode.

28. A method of operating a very low dropout dual supply voltage regulator comprising:

providing an output transistor between a power input node and an output node;

monitoring said power input node to sense whether said power input node is LOW;

preventing a driver transistor from increasing drive current without limitation to said output transistor when said monitoring monitors that said power input node is LOW, said driver transistor being coupled to a control input node that is separate from said power input node;

permitting said driver transistor to supply drive current to said output transistor to allow output voltage to rise as power input node voltage rises when said monitoring monitors that said power input node is LOW; and driving said output transistor with said drive current from said driver transistor when said monitoring senses that said power input node is other than LOW.

29. The method of claim 28, wherein said monitoring and preventing are performed by a PNP transistor having a base coupled to said power input node.

30. The method of claim 28, wherein said monitoring and preventing are performed by a Schottky diode coupled to said power input node.

31. A very low dropout dual supply voltage regulator circuit comprising:

a control input node that receives control power;

a power input node that receives output power, said power input node being isolated from said control input node;

an output node;

a drive circuit that provides drive current in response to said control power, said drive circuit being coupled to said control node, said drive circuit comprising a driver transistor;

an output circuit coupled between said power input node and said output node, said output circuit comprising an output transistor coupled to said driver transistor; and a power-on circuit coupled to said power input node and to said drive circuit that causes said drive circuit to decrease said drive current to said output circuit when said power input node is LOW while permitting said drive current to cause output voltage to rise as power input node voltage rises when said power input node is LOW, said power-on circuit comprising at least one circuit device selected from the group consisting of a transistor and a diode, said circuit device having at least one P-type region and at least one N-type region, said N-type region being coupled to said power input node.

* * * * *